US012686043B2

(12) United States Patent
Hollaus et al.

(10) Patent No.: US 12,686,043 B2
(45) Date of Patent: Jul. 21, 2026

(54) ROLLING WITH MINIMISATION OF A DROP IN THE BENDING FORCE UPON ENTRY

(71) Applicant: Primetals Technologies Germany GmbH, Erlangen (DE)

(72) Inventors: Andreas Hollaus, Erlangen (DE); Matthias Kurz, Erlangen (DE)

(73) Assignee: Primetals Technologies Germany GmbH (DE)

( * ) Notice: Subject to any disclaimer, the term of this patent is extended or adjusted under 35 U.S.C. 154(b) by 410 days.

(21) Appl. No.: 18/261,601

(22) PCT Filed: Jan. 13, 2022

(86) PCT No.: PCT/EP2022/050610

§ 371 (c)(1),
(2) Date: Jul. 14, 2023

(87) PCT Pub. No.: WO2022/152781

PCT Pub. Date: Jul. 21, 2022

(65) Prior Publication Data

US 2024/0075508 A1 Mar. 7, 2024

(30) Foreign Application Priority Data

Jan. 18, 2021 (EP) ..... 21152081

(51) Int. Cl.
*B21B 37/38* (2006.01)
*B21B 13/02* (2006.01)
*B21B 29/00* (2006.01)

(52) U.S. Cl.
CPC ..... *B21B 37/38* (2013.01); *B21B 2269/04* (2013.01)

(58) Field of Classification Search
CPC ..... B21B 37/38; B21B 2269/04; B21B 29/00; B21B 2013/025; B21B 2013/028; B21B 2273/08; B21B 2273/14
See application file for complete search history.

(56) References Cited

U.S. PATENT DOCUMENTS 8,459,074 B2 6/2013 Hofer et al.
2010/0031723 A1* 2/2010 Hofer ..... B21B 37/68 72/199

FOREIGN PATENT DOCUMENTS

DE 4331261 A1 * 4/1994 ..... B21B 13/142
DE 102006059709 A1 6/2008
(Continued)

OTHER PUBLICATIONS

English translate (DE4331261A1), retrieved date Oct. 10, 2025.*
(Continued)

*Primary Examiner* — Mohammed S. Alawadi
(74) *Attorney, Agent, or Firm* — OSTROLENK FABER LLP

(57) ABSTRACT

In a roll stand, the working roll inserts are pressed apart by a bending system. A base set-point value (FBB*) is supplied to a bending controller to determine a resultant set-point value (FB*). An actual value (FB) of the bending force is also supplied to the bending controller to determine a base controlled variable (SB) for the bending system so that, when the bending system is actuated with (SB), (FB) is brought as close as possible to (FBB*). From a stabilisation time (t3) after an entry time (t2), the bending controller determines (FB*), additionally taking an actual rolling force (F) into consideration. During an entry time period before (t2) and ending at (t3), an additional set-point value (FBZ*) is supplied to the bending controller for determining (FB*). (FB) is thus greater than (FBB*).

8 Claims, 9 Drawing Sheets

(56) References Cited

FOREIGN PATENT DOCUMENTS

| | | | | | |
|---|---|---|---|---|---|
| JP | S5750207 | A | | 3/1982 | |
| JP | S5961512 | A | * | 4/1984 | ..... B21B 13/142 |
| JP | S59-156509 | A | | 9/1984 | |
| JP | S61-88910 | A | | 5/1986 | |
| JP | S61-140313 | A | | 6/1986 | |
| JP | H05-269516 | A | | 10/1993 | |
| JP | H08-215730 | A | | 8/1996 | |
| JP | 2016-131975 | A | | 7/2016 | |

OTHER PUBLICATIONS

English translate (JPS5961512A), retrieved date Oct. 10, 2025.*
Office Action mailed Sep. 2, 2024 for corresponding Japanese Patent Application No. 2023-543046 with its English translation.
International Search Report mailed Apr. 12, 2022 in corresponding PCT International Application No. PCT/EP2022/050610.

* cited by examiner

ROLLING WITH MINIMISATION OF A DROP IN THE BENDING FORCE UPON ENTRY

CROSS-REFERENCE TO RELATED APPLICATIONS

The present application is a 35 U.S.C. §§ 371 national stage application of International Application No. PCT/EP2022/050610, filed Jan. 13, 2022, which claims priority to European Patent Application EP21152081, filed Jan. 18, 2021, the contents of which are incorporated herein by reference.

TECHNICAL FIELD

The present invention proceeds from an operating method for a roll stand for rolling a flat rolling stock made of metal, which has a head of the rolling stock,

- wherein the roll stand has at least working rollers and support rollers,
- wherein the working rollers are mounted in working roller chocks and a bending system that presses the working roller chocks apart acts on the working roller chocks,
- wherein the head of the rolling stock reaches the roll stand at an actual entry time,
- wherein a base setpoint is supplied to a bending feedback controller and the bending feedback controller determines a resultant setpoint taking into account the base setpoint,
- wherein the bending feedback controller furthermore is supplied with an actual value of the bending force,
- wherein the bending feedback controller by means of the resultant setpoint and the actual value determines a basic manipulated variable for the bending system, so that when the bending system is controlled with the basic manipulated variable, the actual value is brought as close as possible to the resulting setpoint,
- wherein the bending feedback controller determines the resultant setpoint as from a stabilization time, which is after the entry time, also taking into account an actual rolling force occurring during the rolling of the flat rolling stock.

The present invention furthermore proceeds from a rolling unit for rolling a flat rolling stock made of metal, which has a head of the rolling stock,

- wherein the rolling unit has a roll stand and a bending feedback controller,
- wherein the roll stand has working rollers and support rollers mounted at least in working roller chocks,
- wherein the roll stand has a bending system that presses the working roller chocks apart,
- wherein the bending feedback controller actuates the bending system,
- wherein the roll stand and the bending feedback controller during the operation of the rolling unit interact with one another in such a manner that they carry out an operating method of this type.

PRIOR ART

Roll stands for rolling a flat rolling stock are often designed as a four-high stand (i.e. as a roll stand with working rollers and support rollers) or as a six-high stand (i.e. as a roll stand with working rollers, support rollers and intermediate rollers disposed between the working rollers and the support rollers). A metal strip is often rolled in them, sometimes also a heavy plate.

A pass schedule is calculated before the rolling of a respective rolling stock. In the scope of the pass schedule calculation, setpoints for the individual actuators of the roll stand are determined, by way of which the actuators are to be operated when rolling the respective rolling stock. The setpoints include at least the adjustment or the rolling force. They most often also include a setpoint—hereinafter referred to as the base setpoint—for the bending force with which the working roller chocks, and thus also the working rollers, are to be pressed apart. The bending force can be used to influence the contour, profile and flatness of the rolling stock.

Other actuators can also be present for influencing the contour, profile and flatness, for example working roller shifting or local cooling. In the case of roll stands for stainless steel, strip edges can also be lubricated to influence the profile. However, the further actuators are not relevant within the scope of the present invention.

The pass schedule calculation is carried out by a higher-level control device, which is usually referred to as the L2 system in industry. The setpoints determined in the scope of the pass schedule calculation are forwarded by the control device to subordinate feedback controllers, which implement real-time control while the rolling stock is being rolled. The entirety of the feedback controllers is usually referred to as the L1 system in industry. The setpoints are specified before the rolling stock reaches the roller gap between the working rollers of the roll stand, i.e. before the entry takes place.

For example, the setpoint for the bending force—i.e. the base setpoint—is predefined to a bending feedback controller. This setpoint is modified by various correction variables during the rolling of the flat rolling stock. One of the correction variables is an additional setpoint that is determined as a function of the rolling force and—similar to an AGC—is intended to compensate for changes in the roller deflection that occur due to a changed rolling force. However, this additional setpoint is only applied after the instabilities that arise during the entry process have been corrected again by the feedback controllers of the L1 system.

The bending feedback controller therefore determines a basic manipulated variable for the bending system during a entry period, which begins before the entry time and ends after the entry time, based solely on the base setpoint and the actual value of the bending force and actuates the bending system according to the determined basic manipulated variable. The determination is made in such a manner that the actual value of the bending force is always approximated as closely as possible to the base setpoint.

When entering, the bending force (i.e. its actual value) drops. The bending feedback controller indeed tries to again correct this drop as quickly as possible. However, a time span of several 100 ms, sometimes of up to 500 ms, elapses until the system is completely corrected.

On the one hand, the drop in the bending force has a negative effect on the resulting contour and the associated profile, as well as the flatness of the rolling stock. However, this can often be accepted. On the other hand, the drop in the bending force leads to a short-term unstable state, the effects of which on the running of the strip cannot always be foreseen. In particular, it can happen that a hook forms in the rolling stock on the outlet side of the roll stand. In some cases, the hook is so large that it hits lateral guides on the outlet side of the roll stand. This can lead to damage to the lateral guides and, in some cases, even to the head of the rolling stock getting caught. In this case, the head of the rolling stock is no longer transported further, while the roll stand continues to push the rolling stock. As a result, the rolling stock bulges (so-called buckling). This leads at least to an unscheduled prolonged interruption of the operation of the roll stand, sometimes even moreover to significant damage to the roll stand or to downstream equipment.

DE 10 2006 059 709 A1 discloses an operating method for a roll stand for rolling a flat metal rolling stock, wherein the working rollers of the roll stand during a period when a head of the rolling stock has not yet reached the roll stand are impinged with a bending force that is at least as great as a balancing force of the upper working roller and the upper support roller (and optionally further rolls disposed between the upper working roller and the upper support roller). From the point at which the head of the rolling stock reaches the roll stand, the bending force is determined in accordance with the technological requirements of the rolling process. The already resulting bending force can be greater or less than the minimum force and also greater or less than the balancing force.

JP S57 050 207 A discloses an operating method for a roll stand for rolling a flat rolling stock made of metal, in which the time at which a head of the rolling stock reaches the roll stand is calculated in advance. From this time, the working rollers of the roll stand are subjected to a bending force by means of a bending system.

JP S59 061 512 A discloses an operating method for a roll stand for rolling a flat rolling stock made of metal, in which a loop lifter disposed upstream of the roll stand detects whether the rolling stock is subjected to tension on the inlet side of the roll stand. As a result, the entry and the exit are recorded. During entry, bending forces acting on the working rollers of the roll stand are adjusted in such a manner that the thickness of the rolling stock decreases toward its lateral edges. During exit, the bending forces are adjusted in an analogous manner as soon as a drop in the load on the loop lifter and thus the discharge of the flat rolling stock from the upstream roll stand is detected.

DE 43 31 261 A1 discloses an operating method for a roll stand for rolling a flat metal rolling stock, in which the working rollers can be subjected to positive and negative bending forces of different magnitudes by means of a bending system.

SUMMARY OF THE INVENTION

The object of the present invention is to create possibilities by means of which the unstable state can be avoided as much as possible.

The object is achieved by an operating method having the features of claim 1. Advantageous design embodiments are the subject matter of the dependent claims.

According to the invention, an operating method of the type mentioned at the outset is designed in that during an entry period that begins before the actual entry time and ends after the actual entry time,

- the bending feedback controller is supplied with an additional setpoint in addition to the base setpoint, so that the bending feedback controller during the entry period determines the resultant setpoint, taking into account not only the base setpoint but also the additional setpoint, and the actual value of the bending force is therefore greater than the base setpoint immediately before the actual entry time, and/or
- by applying an additional manipulated variable to the basic manipulated variable, a resultant manipulated variable is determined, which is supplied to the bending system and the bending system is thereby controlled in such a manner that the resultant manipulated variable is greater than the basic manipulated variable, and/or
- a selection member is supplied with the basic manipulated variable and a minimum manipulated variable, and the selection member supplies the maximum of basic manipulated variable and minimum manipulated variable to the bending system.

If the actual value of the bending force immediately before the entry time is greater than the base setpoint, the bending force begins to drop at a higher level. This reduces the probability and the magnitude of any possible hook formation. If the resultant manipulated variable is greater than 0, the hydraulic valve, by means of which hydraulic fluid is supplied to the bending system, is at least partially open at the time of entry. It therefore does not have to be opened at the time of entry. The entry of the rolling stock therefore leads to a smaller drop in the bending force. This also reduces the probability and the extent of any possible hook formation. A resultant manipulated variable greater than 0 can be guaranteed by suitably specifying the additional manipulated variable. For example, the additional manipulated variable can be set to 110% of the maximum possible value. Even if the bending feedback controller determines the minimum possible value as the basic manipulated variable, the hydraulic valve is therefore opened to at least −100%+110%=10%.

As an alternative to specifying the additional manipulated variable, the minimum manipulated variable can also be supplied directly. In this case, if the hydraulic valve has already been opened by the basic manipulated variable and the minimum manipulated variable is smaller than the basic manipulated variable, the hydraulic valve remains open without changing the opened position. However, regardless of the value of the basic manipulated variable, the hydraulic valve is always opened at least as far as is specified by the minimum manipulated variable. By suitably selecting the minimum manipulated variable (specifically greater than 0), it can thus also be ensured in this case that the hydraulic valve is at least partially opened at the time of entry.

It is possible that the additional setpoint and/or the additional manipulated variable and/or the minimum manipulated variable are switched abruptly to their maximum value at the beginning of the entry period. It is also possible for the additional setpoint and/or the additional manipulated variable and/or the minimum manipulated variable to be abruptly reduced to zero at the end of the entry period. Preferably, however, the additional setpoint and/or the additional manipulated variable and/or the minimum manipulated variable are raised strictly monotonically from 0 to their maximum value from the beginning of the entry period with a finite gradient and/or are lowered strictly monotonically from their maximum value to zero at the end of the entry period with a finite gradient. This results in smoother transitions, which place less stress on the bending feedback controller, the hydraulic valve and the bending system in particular and furthermore also lead to a more stable transition, especially when the additional setpoint and/or the additional manipulated variable and/or the minimum manipulated variable is reduced to 0.

Possibilities for raising and lowering with a finite gradient are well known and familiar to a person skilled in the art. For example, ramping can take place or a binary switching process can be smoothed out by appropriate filtering.

As a rule, an expected entry time is determined by means of path tracking for the rolling stock. In this case, the beginning of the entry period preferably precedes the expected entry time by a predetermined early time span.

The predetermined early time span is dimensioned, for example, in such a manner that the additional setpoint and/or the additional manipulated variable and/or the minimum manipulated variable reach their maximum value at a time of which the spacing from the expected entry time is at least as great as an error tolerance between the actual and the expected entry time. A person skilled in the art can readily estimate the error tolerance based on the inaccuracies in tracking the path of the head of the rolling stock, which are known to him. The predetermined time span is typically in the range between 0.5 s and 2.0 s, in particular between 0.8 s and 1.5 s, for example approximately 1.0 s.

It is possible for the end of the entry period to follow the expected entry time by a predetermined late time span. Preferably, however, the end of the entry period follows the actual entry time by a predetermined late time span. The actual entry time can be easily detected, for example due to an abrupt increase in the actual rolling force or the rolling torque actually applied by drives of the working rollers.

In both cases, the predetermined late time span is dimensioned such that the additional setpoint and/or the additional manipulated variable and/or the minimum manipulated variable retain their maximum value up to a time of which the spacing from the expected or actual entry point has a predetermined value. From this time, the additional setpoint and/or the additional manipulated variable and/or the minimum manipulated variable can be reduced to 0. The mentioned value—i.e. the time span during which the additional setpoint and/or the additional manipulated variable and/or the minimum manipulated variable are still kept at their maximum value—is determined by the basic design and dimensioning of the bending system. The value is usually in the range between 0.1 s and 1.0 s, in particular between 0.2 s and 0.6 s, for example 0.3 s or 0.4 s.

Preferably, before the flat rolling stock is rolled, a maximum value of the additional setpoint and/or the additional manipulated variable and/or the minimum manipulated variable are determined as a function of properties of the rolling stock and/or as a function of an expected rolling force. As a result, the corresponding maximum value can be optimally adapted to the roll pass to be specifically carried out. Alternatively or additionally, it is possible for the maximum value of the additional setpoint and/or the additional manipulated variable and/or the minimum manipulated variable to be determined in such a manner that the resultant manipulated variable assumes its maximum possible value immediately before the actual entry time. This procedure can be useful in particular in the case of the front stands of a multi-stand finishing train or in the case of a roll stand for rolling heavy plate (plate mill).

The additional setpoint and/or the additional manipulated variable and/or the minimum manipulated variable are preferably determined in such a manner that a drop in the actual value of the bending force at the actual entry time that would occur without the additional setpoint and/or the additional manipulated variable and/or the minimum manipulated variable is compensated for by at least 50%. Thus, if the base setpoint has the value X and without the additional setpoint and/or the additional manipulated variable and/or the minimum manipulated variable there would be a drop to the value Y at entry, the additional setpoint and/or the additional manipulated variable and/or the minimum manipulated variable are preferably determined in such a manner that the bending force drops at most to the value (X+Y)/2, preferably even only to a value that is greater than (X+Y)/2. It is particularly preferred if the bending force drops at most to the base setpoint, i.e. to the value X.

The object is further achieved by a rolling unit. According to the invention, in a rolling unit of the type mentioned at the outset, the roll stand and the bending feedback controller during operation of the rolling unit interact with one another in such a manner that they carry out an operating method according to the invention.

BRIEF DESCRIPTION OF THE DRAWINGS

The above-described properties, features and advantages of this invention and the manner in which they are achieved will become clearer and more easily understandable in connection with the following description of the exemplary embodiments, which are explained in more detail in conjunction with the drawings, in which, in a schematic illustration.

DESCRIPTION OF THE EMBODIMENTS

Figure 1:
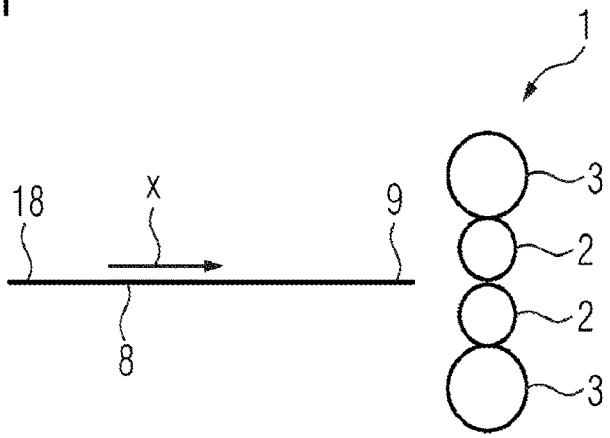
FIG. 1 shows a roll stand from the side, before rolling a rolling stock.

According to FIGS. 1 to 4, a roll stand 1 has working rollers 2 and support rollers 3. Within the scope of the present invention, this represents the minimum configuration of the roll stand 1. In addition, the roll stand 1 could also have intermediate rollers. In this case, the intermediate rollers would be disposed between the working rollers 2 and the support rollers 3. Corresponding to the illustration in FIG. 4, the working rollers 2 have bearing journals 4 with which the working rollers 2 are mounted in working roller chocks 5. In an analogous manner, the support rollers 3 have bearing journals 6 with which the support rollers 3 are mounted in support roller chocks 7.

While rolling a rolling stock 8, a rolling force F is applied to the support roller chocks 7 and thus consequently also to the support rollers 3. The rolling force F is transmitted to the working rollers 2 via the support rollers 3. This is well known to persons skilled in the art. The rolling stock 8 itself consists of metal, for example steel or aluminum. It is a flat rolling stock, for example a strip or a heavy plate. Said rolling stock 8 has a head of the rolling stock 9. The head of the rolling stock 9 is that area of the rolling stock 8 that is first rolled in the roll stand 1. Correspondingly, a transport direction of the rolling stock 8 is denoted by x in FIGS. 1 to 3.

The roll stand 1 also has a bending system 10. The bending system 10 typically consists of at least two hydraulic cylinder units 11, 12, which act on the drive side and operator side on the working roller chocks 5 and thereby press the working roller chocks 5 apart. The bending system 10 serves for adjusting the contour, profile and flatness of the rolling stock 8. In some cases, several hydraulic cylinder units 11, 12 respectively act on the working roller chocks 5. In this case, there are correspondingly more hydraulic cylinder units 11, 12.

Figure 5:
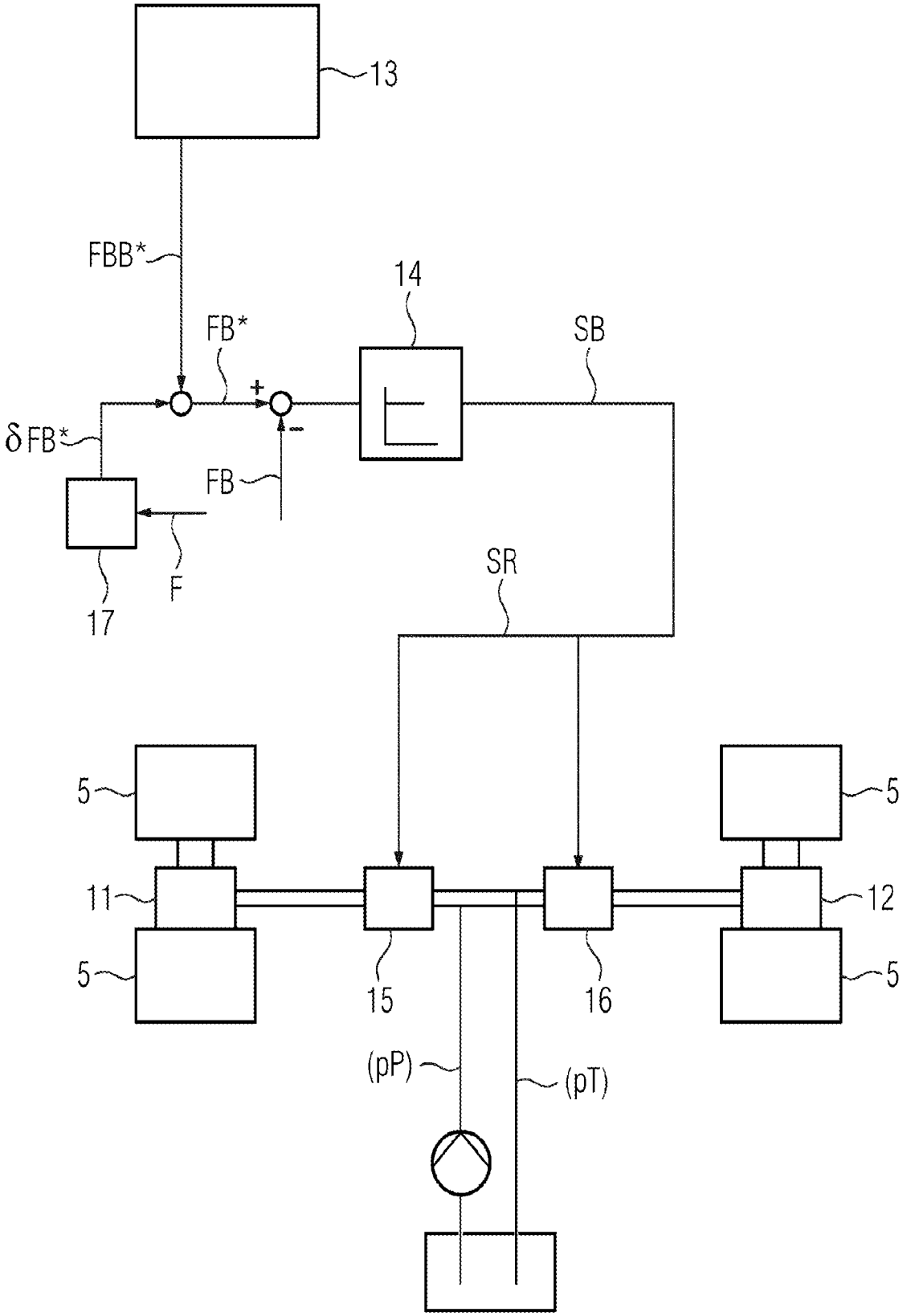
FIG. 5 shows part of a control structure for the roll stand of FIGS. 1 to 4.

According to FIG. 5, the roll stand 1 is controlled by a control structure. The control structure usually comprises a control device 13 and in any case a bending feedback controller 14.

The control device 13 is a higher-level control device that acts as an L2 system, that is, within the scope of a pass schedule calculation for subordinate feedback controllers, it determines their setpoints. In FIG. 5, only a single feedback controller is shown in this regard, specifically a bending feedback controller 14. In practice, of course, other feedback controllers are also present. In the scope of the present invention, however, only the bending feedback controller 14 is important. Therefore, only the bending feedback controller 14 is also shown and only the bending feedback controller 14 will also be explained below.

The pass schedule calculation is carried out for the rolling stock 8 even before the rolling stock 8 is rolled in the roll stand 1 (see FIG. 1). In the scope of the calculation of the pass schedule, the control device 13 determines setpoints for the adjustment of the roll stand 1, possibly roller shifting and others. In particular, the control device 13 determines a base setpoint FBB* of the bending force in the scope of the pass schedule calculation for rolling the rolling stock 8 in the roll stand 1. The base setpoint FBB* can be a single, singular value that is constant over time. Alternatively, separate base setpoints FBB* can be determined in each case for different sections of the strip to be rolled. In this case, the base setpoint FBB* varies over time.

Figure 6:
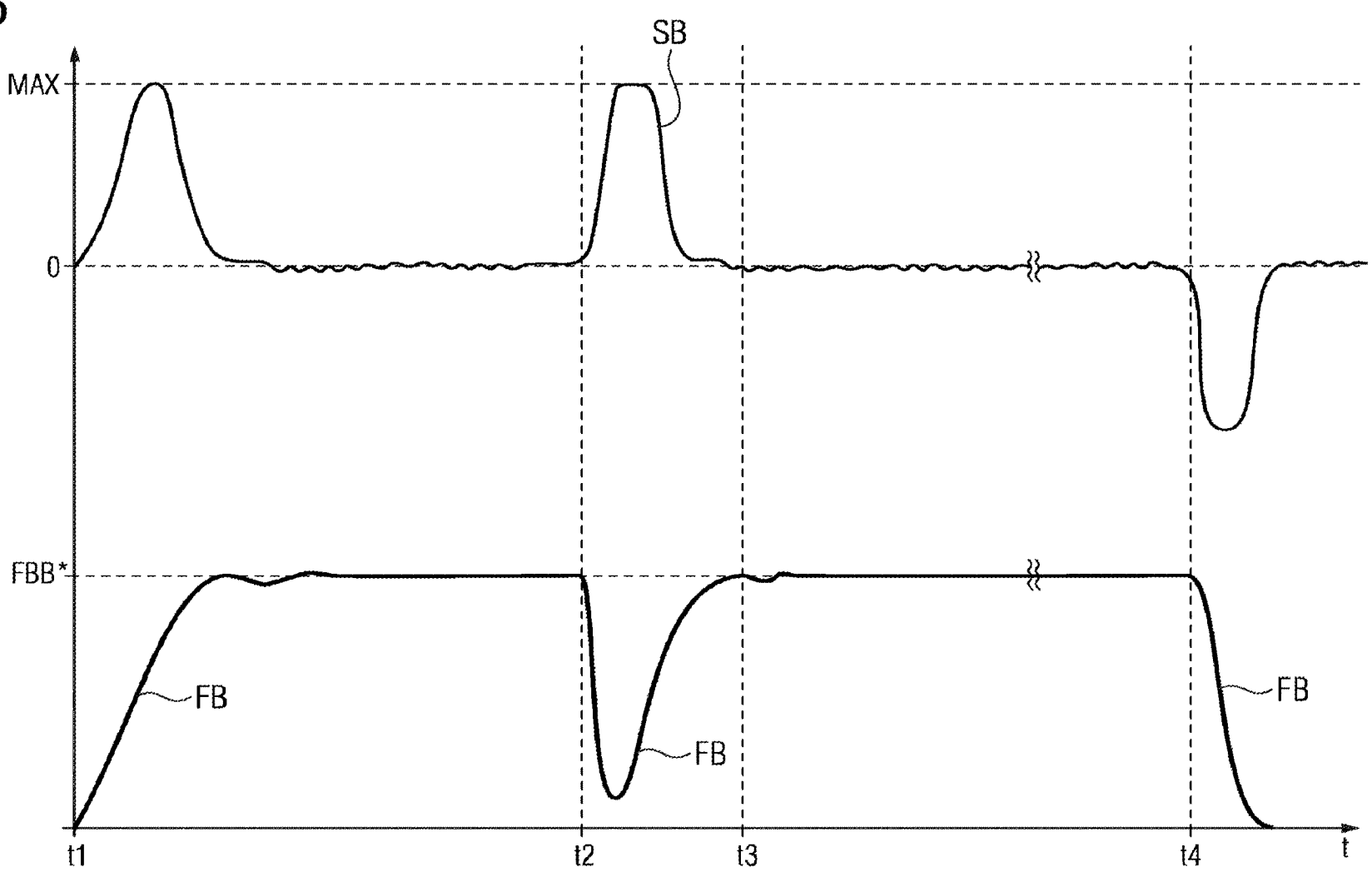
FIG. 6 shows a time diagram for an operating method for the roll stand of FIGS. 1 to 4 according to the prior art.

The base setpoint FBB* is supplied to the bending feedback controller 14 as from a time t1 (see FIG. 6). The time t1 is referred to below as the default time t1. At the default time t1, the head of the rolling stock 9 has not yet reached the roll stand 1 (see FIG. 1). The base setpoint FBB* is generally supplied by the control device 13. In principle, however, the base setpoint FBB* can also be supplied to the bending feedback controller 14 in some other way.

An actual value FB of the bending force is also supplied to the bending feedback controller 14. Possibilities for detecting or determining the actual value FB are generally known to persons skilled in the art. For example, in order to determine the bending force FB, working pressures pP, pT in working spaces of the hydraulic cylinder units 11, 12 can be mathematically linked to one another in connection with the effective working areas.

The bending feedback controller 14 controls the bending system 10. In particular, the bending feedback controller 14 uses a resultant setpoint FB* and the actual value FB to determine a basic manipulated variable SB for the bending system 10. The basic manipulated variable SB is determined in such a manner that the actual value FB is approximated as closely as possible to the resultant setpoint FB* if the bending system 10 is controlled with the basic manipulated variable SB. The resultant setpoint FB* is determined by the bending feedback controller 14 using at least the base setpoint FBB*. The resultant setpoint FB* can temporarily be identical to the base setpoint FBB*. At least temporarily, however, other variables are also included in the resultant setpoint FB*. This is yet to become apparent. Utilizing the basic manipulated variable SB, the bending feedback controller 14 determines a resultant manipulated variable SR. The resultant manipulated variable SR can temporarily be identical to the basic manipulated variable SB. In the normal operation, i.e. during the stable rolling of the flat rolling stock 8, the bending feedback controller 14 outputs the resultant manipulated variable SR to the bending system 10 and thereby controls the bending system 10.

The bending feedback controller 14 determines, as a basic manipulated variable SB and also as a resultant manipulated variable SR, in particular an opening state for hydraulic valves 15, 16, by means of which working spaces of the hydraulic cylinder units 11, 12 are subjected to a high working pressure pP (pump pressure) and a low working pressure pT (tank pressure). The hydraulic valves 15, 16 are usually continuously adjustable valves, i.e. proportional valves or servo valves.

Due to the specification of the base setpoint FBB*, the bending feedback controller 14 thus initially determines a relatively large basic manipulated variable SB from the default time t1, possibly even a maximum possible value MAX of the basic manipulated variable SB (and thus also of the resultant manipulated variable SR). However, it reduces the basic manipulated variable SB back to 0 or almost to zero as soon as the actual value FB of the bending force is matched as closely as possible to the base setpoint FBB*. In addition, it is pointed out in this context that within the scope of the present invention, positive values of the basic manipulated variable SB correspond to an increase in the bending force (up to a technically maximum possible value), negative values to a reduction in the bending force.

Figure 2:
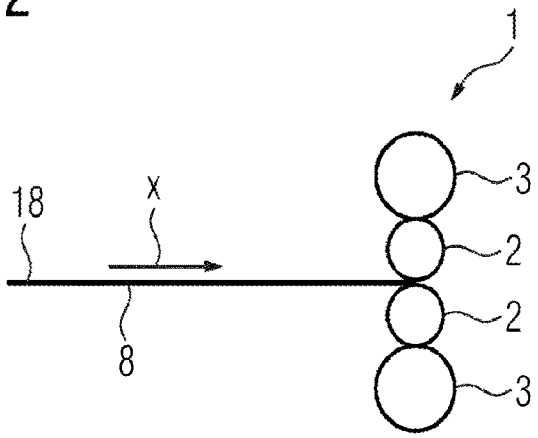
FIG. 2 shows the rolling stock from FIG. 1 from the side at entry, i.e. at the beginning of the rolling of the rolling stock.

At a time t2, the head of the rolling stock 9 reaches the roll stand 1 (see FIG. 2). The time t2 is referred to below as the actual entry time t2. The actual entry time t2 can easily be detected, for example by recognizing a significant increase in the rolling force F or a rolling torque of a drive of the working rollers 2. Upon entry, the bending force FB drops significantly. Drops of 50% and more are quite possible. Within a relatively short time, the bending feedback controller 14 opens the hydraulic valves 15, 16 by specifying a corresponding basic manipulated variable SB and thereby sets the bending force back to its resultant setpoint FB*. The time it takes to restore the bending force is usually well below 1 s, for example around 500 ms.

Figure 3:
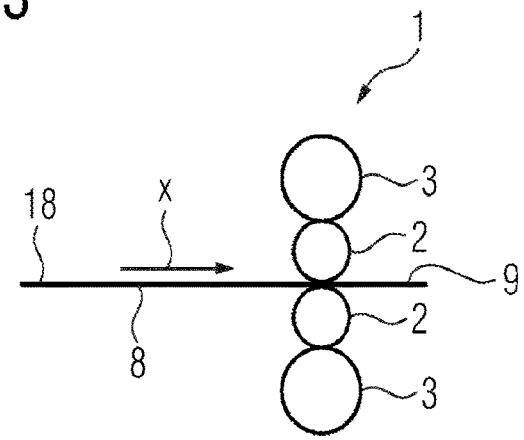
FIG. 3 shows the roll stand from FIG. 1 from the side during the rolling of the rolling stock.
Figure 4:
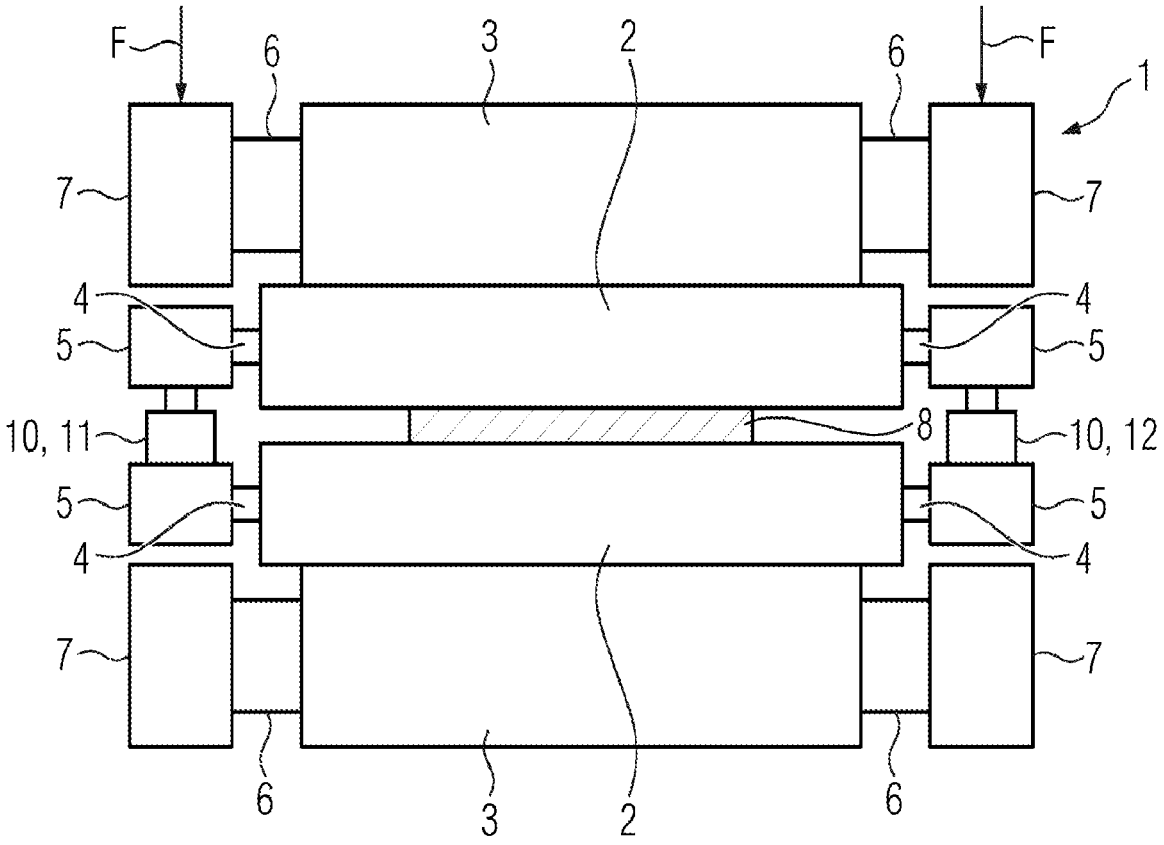
FIG. 4 shows part of the roll stand of FIGS. 1 to 3 from the front.

After the actual entry time t2, the rolling stock 8 is rolled (see FIG. 3). Immediately after the entry time t2, however, the roll stand 1 is in a comparatively unstable state, which is corrected again by the various feedback controllers assigned to the roll stand 1 (including the bending feedback controller 14). A stable state is reached again at a stabilization time t3. The time interval between the stabilization time t3 and the entry time t2 is determined by the design and dimensioning of the roll stand. Typically, said time interval is in the range of 1 s and less, for example 500 ms or even less.

From the stabilization time t3, a correction value δFB* is determined by means of an evaluation unit 17. The correction value δFB* is applied to the base setpoint FBB*. As from the stabilization time t3, the resultant setpoint FB* is thus the sum of the base setpoint FBB* and the correction value δFB*. The correction value δFB* is determined in the evaluation unit 17 as a function of the (actual) rolling force F. The evaluation unit 17 thus implements a so-called DPC (="bending AGC").

If necessary, further correction variables can also be additionally supplied to the bending feedback controller 14 as from the stabilization time t3, for example as from a flatness feedback control or from a profile feedback control. A correction based on thermal influencing factors is also possible. However, at least the compensation of influences caused by the rolling force is provided.

At a time t4, a rolling stock foot 18 (see FIGS. 1 to 3) of the rolling stock 8 leaves the roll stand 1. Analogously to the actual entry time t2, the actual exit time t4 can also be easily detected, in particular by recognizing a significant drop in the rolling force F or a rolling torque of a drive of the working rollers 2. The time t4 is referred to below as exit time. As a rule, the application of the correction value δFB* to the base setpoint FBB* is frozen shortly before the exit time t4, i.e. the correction value δFB* last determined is retained. However, this is of secondary importance within the scope of the present invention.

The core of the prior art procedure explained above is retained, but modified and supplemented according to the invention. A possible modification and addition is explained in more detail below in conjunction with FIGS. 7 and 8, a further possible modification and addition in conjunction with FIGS. 9 and 10, and yet another modification and addition in conjunction with FIG. 11.

Figure 7:
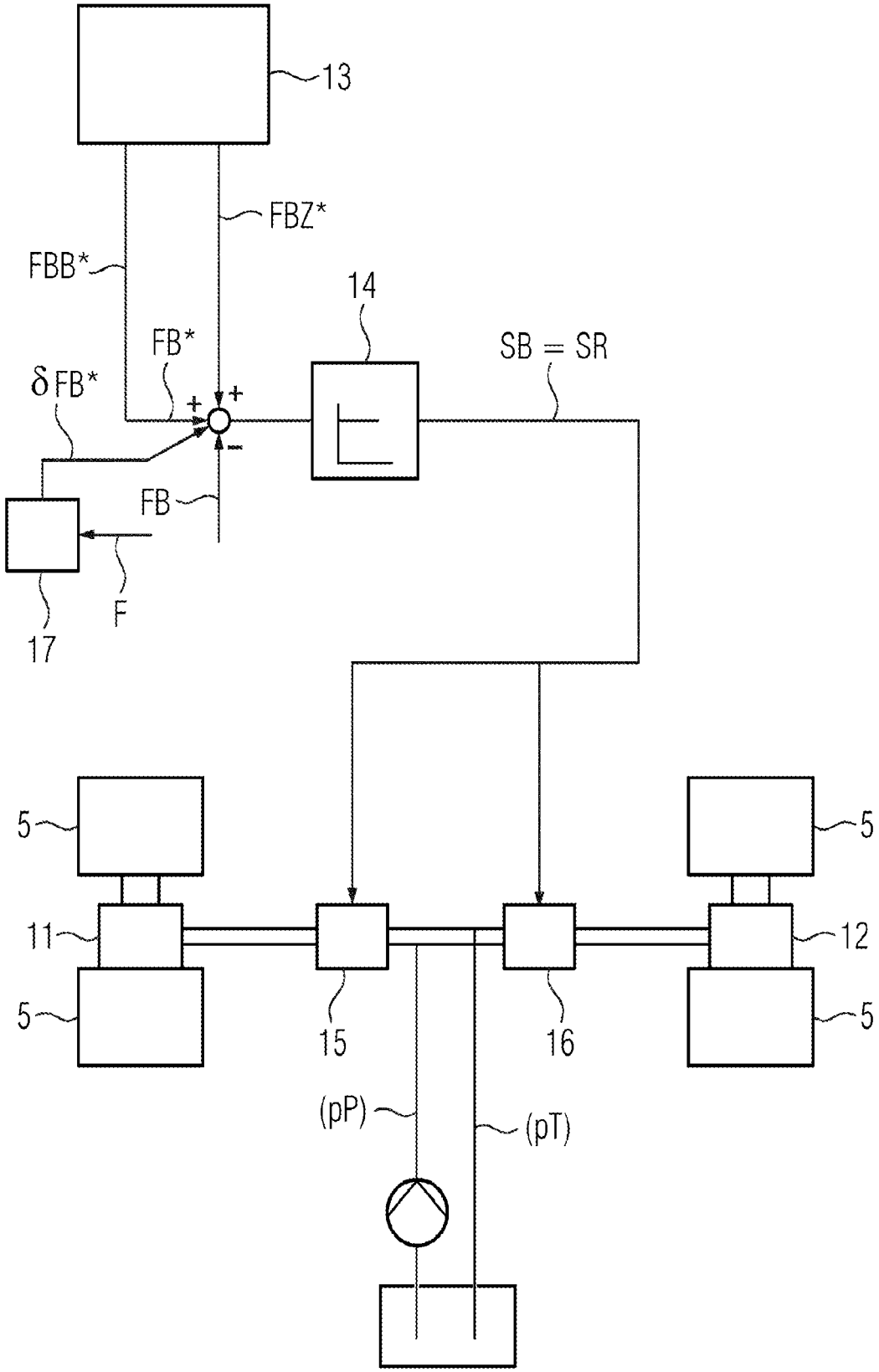
FIG. 7 shows part of a control structure for the roll stand of FIGS. 1 to 4 according to a first embodiment of the present invention.
Figure 8:
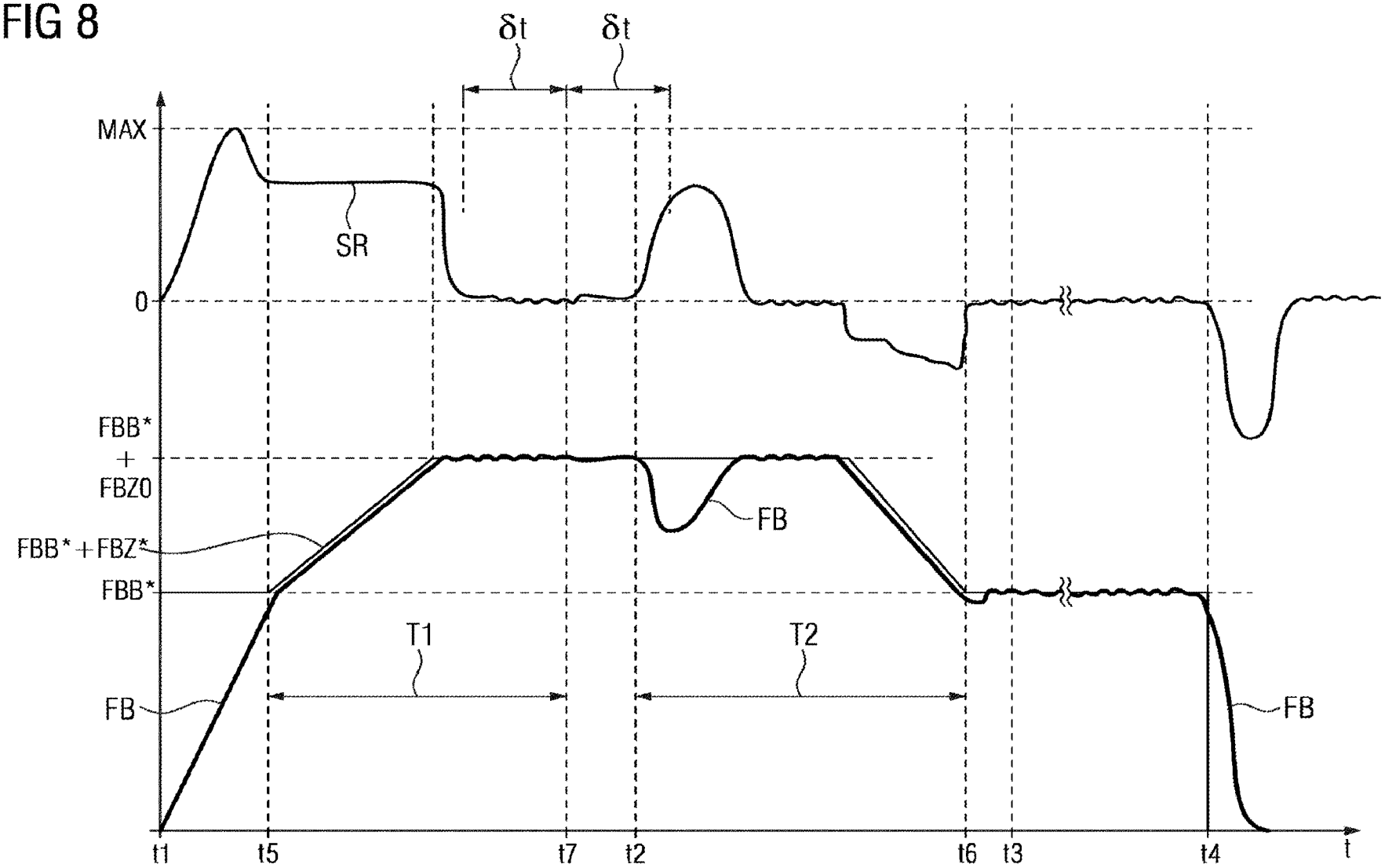
FIG. 8 shows a time diagram for an operating method for the roll stand of FIGS. 1 to 4 according to the first embodiment of the present invention.

As part of the design embodiment according to FIGS. 7 and 8, the bending feedback controller 14 is supplied with an additional setpoint FBZ* during a entry period—in addition to the base setpoint FBB*. The additional setpoint FBZ* can be supplied to the bending feedback controller 14 by the control device 13. However, said additional setpoint FBZ* can also be specified in some other way, for example by an operator (not illustrated).

The entry period begins at a start time t5 and ends at an end time t6. The start time t5 is before the actual entry time t2. The end time t6 is after the actual entry time t2. Said end time t6 is usually before the stabilization time t3. Said end time t6 can also coincide with the stabilization time t3. The end time t6 should at least typically not be after the stabilization time t3, however. This is because, as from the stabilization time t3, the sense and purpose of the feedback controls of the roll stand 1 is no longer to guarantee a stable start of the rolling process. Rather, it is now the sense and purpose of the feedback controls of the roll stand 1 to roll the rolling stock 8 to its target properties, in particular to its target thickness and its target profile or its target contour. A specification of the additional setpoint FBZ* going beyond the stabilization time t3 would be disadvantageous to this end.

The additional setpoint FBZ* is applied to the base setpoint FBB*. The supply of the additional setpoint FBZ* to the bending feedback controller 14 causes the bending feedback controller 14 to determine the sum of the base setpoint FBB* and the additional setpoint FBZ* as the resultant setpoint FB*. The basic manipulated variable SB is thus determined in such a manner that the actual value FB of the bending force is approximated as closely as possible to this sum. Due to the modified setpoint (FBB*+FBZ* instead of FBB*), the actual value FB of the bending force immediately before the entry time t2 is greater than the base setpoint FBB*.

Figure 9:
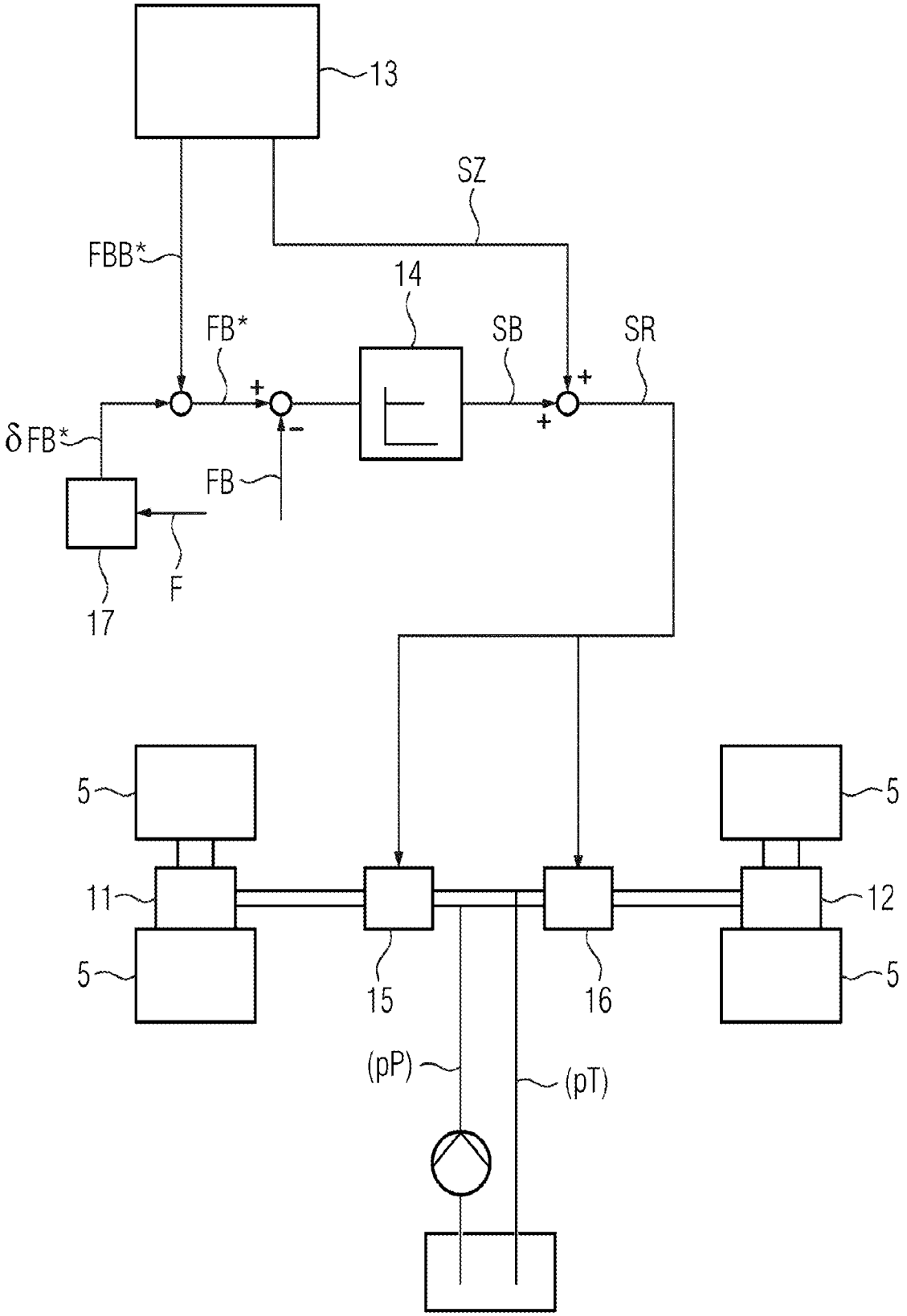
FIG. 9 shows part of a control structure for the roll stand of FIGS. 1 to 4 according to a second embodiment of the present invention.
Figure 10:
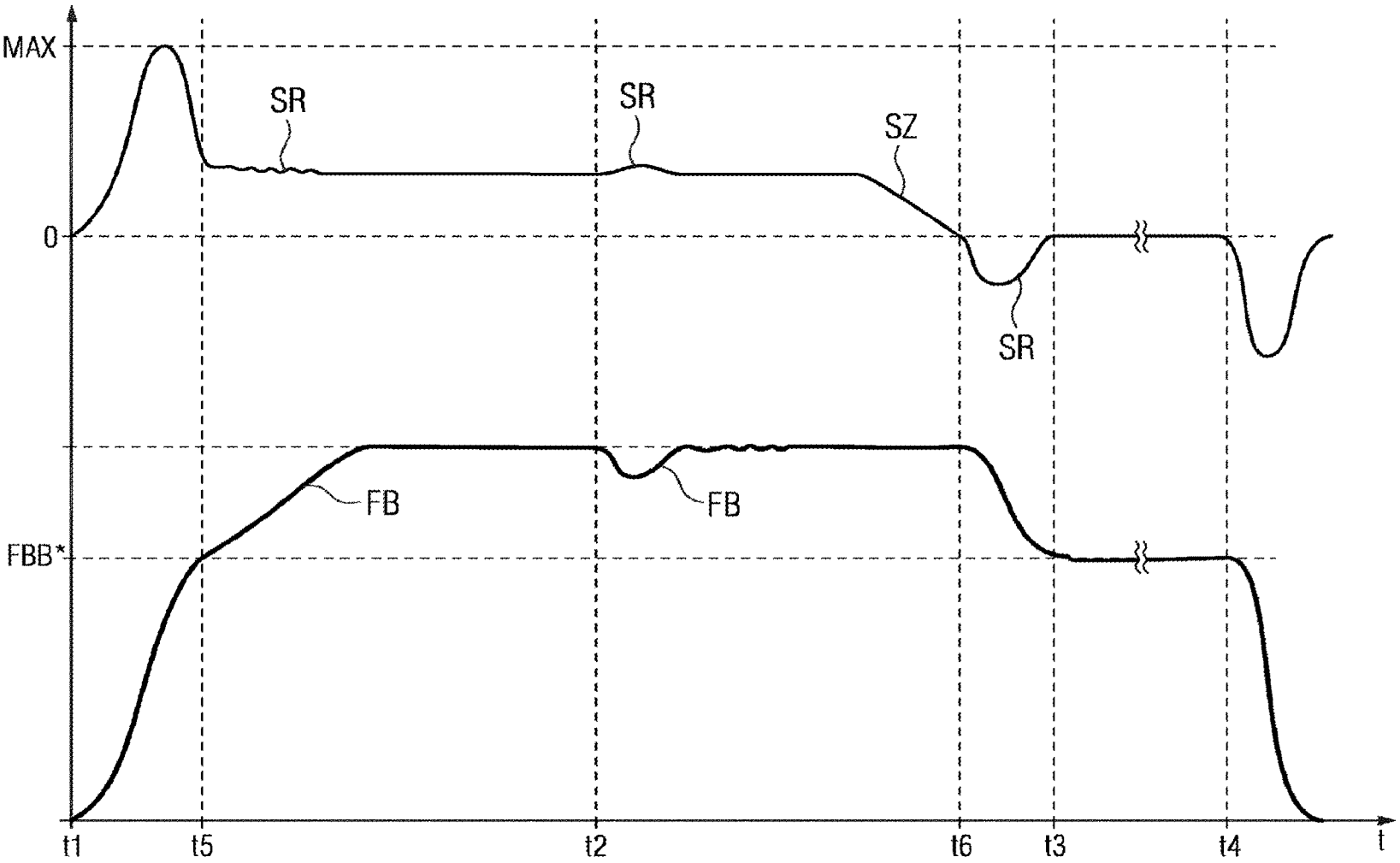
FIG. 10 shows a time diagram for an operating method for the roll stand of FIGS. 1 to 4 according to the second embodiment of the present invention.
Figure 11:
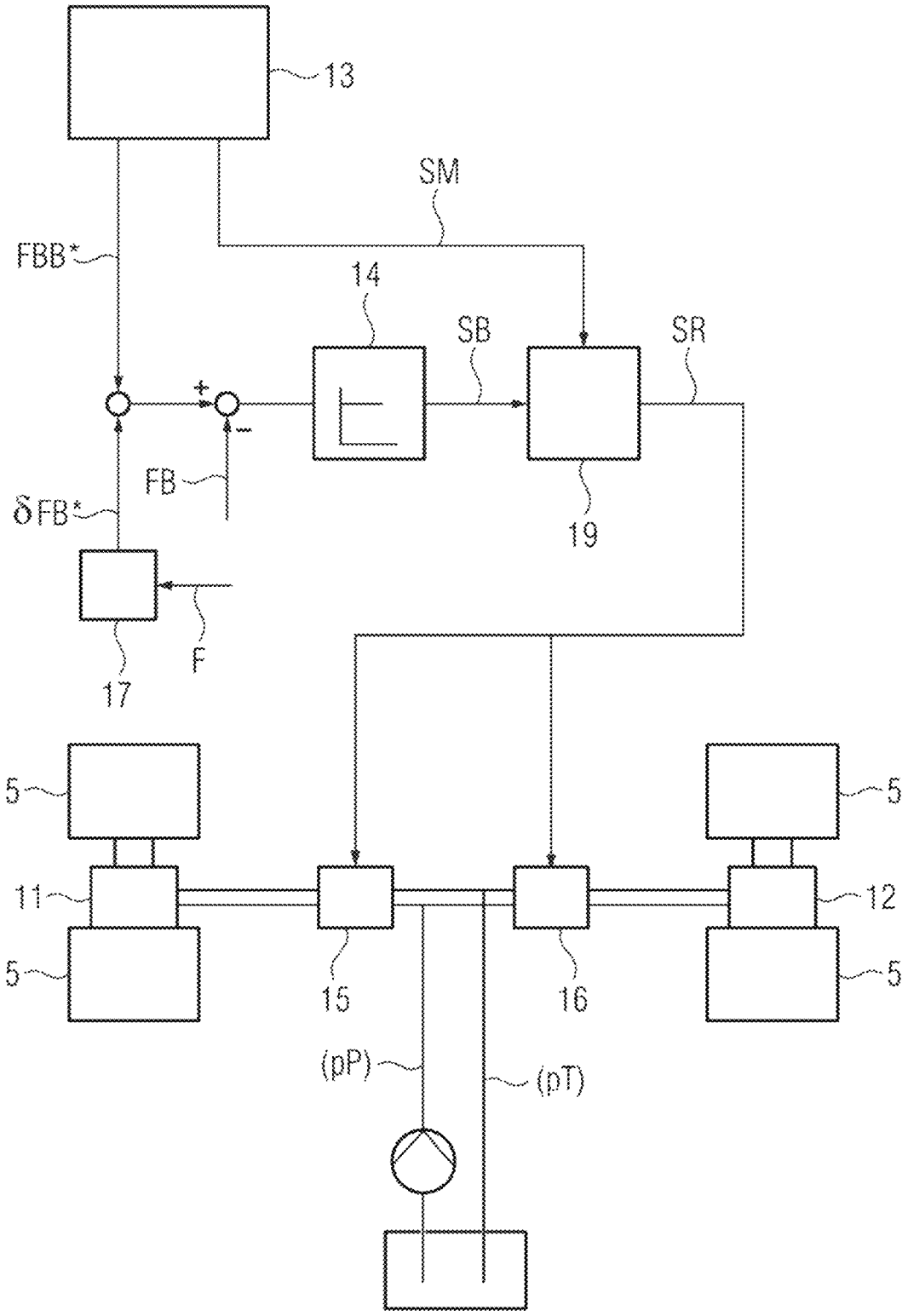
FIG. 11 shows part of a control structure for the roll stand of FIGS. 1 to 4 according to a third embodiment of the present invention.

In the scope of the design embodiment according to FIGS. 9 and 10, an additional manipulated variable SZ is applied to the basic manipulated variable SB during the entry period. The sum of the basic manipulated variable SB and the additional manipulated variable SZ is thus supplied to the hydraulic valves 15, 16 as the resulting manipulated variable SR. As a result, the resultant manipulated variable SR is thus greater than the basic manipulated variable SB immediately before the actual entry time t2. The additional manipulated variable SZ can be supplied to the bending feedback controller 14 by the control device 13. However, it can also be specified in some other way, for example by an operator (not shown).

In the design embodiment according to FIG. 9, the basic manipulated variable SB and the additional manipulated variable SZ are added on the output side of the bending feedback controller 14. In the design embodiment according to FIG. 11, on the other hand, the basic manipulated variable SB and a minimum manipulated variable SM are supplied to a selection member 19 on the output side of the bending feedback controller 14. The selection member 19 selects the larger of the manipulated variables SB, SM supplied to it and supplies the selected manipulated variable to the bending system 10 as the resultant manipulated variable SR. In this design embodiment, on the one hand, it is not necessary to specify the additional setpoint FBZ*, since the bending feedback controller 14 can cause the resultant manipulated variable SR to be greater than the minimum manipulated variable SM. However, the bending feedback controller 14 cannot cause the resultant manipulated variable SR to be smaller than the minimum manipulated variable SM. The minimum manipulated variable therefore defines a minimum actuation state of the bending system 10.

Most typically, it is sufficient to take either the procedure according to FIGS. 7 and 8 or the procedure according to FIGS. 9 and 10. In principle, however, it is also possible to combine the two procedures with one another. For example, the additional manipulated variable SZ can indeed primarily be applied, so that the actual value FB of the bending force is increased. In this case, the additional setpoint FBZ* can be updated accordingly at the same time, so that the bending feedback controller 14 does not counteract the increase in the bending force due to the deviation of the actual value FB of the bending force from the base setpoint FBB*. However, even without updating the additional setpoint FBZ*, it can be achieved that the resultant manipulated variable SR is necessarily positive. All that is required for this is to select the additional manipulated variable SZ sufficiently large. The design embodiment according to FIG. 11 most typically does not have to be combined with one of the design embodiments of FIGS. 7 to 10.

Various advantageous design embodiments of the present invention can also be seen in particular from FIGS. 8 and 10, and also from FIGS. 7 and 9 in individual cases. As a result, the same applies to the design embodiment of FIG. 11 too. These design embodiments are not necessary for the implementation of the basic principle of the present invention, but offer additional advantages. The design embodiments will be explained individually in more detail hereunder. They can be implemented independently of one another, but can also be combined with one another as required. Furthermore, the design embodiments will be explained hereunder without exception in conjunction with FIG. 8 and partially FIG. 7, i.e. for the case in which the additional setpoint FBZ* is specified. However, the advantageous design embodiments can also be implemented in a completely analogous manner if the additional manipulated variable SZ or the minimum manipulated variable SM are specified.

One possible design embodiment relates to the way in which the additional setpoint FBZ* is specified from the start time t5. In particular, the additional setpoint FBZ* is preferably raised strictly monotonously and with a finite gradient from 0 to a maximum value FBZ0* from the start time t5. The period during which this increase takes place can be in particular in the range of several 100 ms. The raising should be completed before the actual entry time t2. Appropriate procedures for gradual raising are generally known to persons skilled in the art.

A further possible design embodiment relates to the manner in which the additional setpoint FBZ* is lowered after the actual entry time t2. In particular, the additional setpoint FBZ* is reduced from its maximum value FBZ0* to 0, preferably strictly monotonically and with a finite gradient. The period of time during which this reduction takes place can in particular also be in the range of several 100 ms. Corresponding procedures for gradual lowering are generally known to persons skilled in the art. However, the value 0 must be reached by the stabilization time t3 at the latest.

A further possible design embodiment relates to the definition of the start time t5. In particular, an expected entry time t7 can be determined as part of path tracking of the head of the rolling stock 9 (the implementation of path tracking is generally known to persons skilled in the art). Accordingly, it is easily possible to determine the start time t5 in such a manner that it is before the expected entry time t7 by a predetermined early time span T1.

The actual entry time t2 can be before or after the expected entry time t7 in time. However, the time deviation is at most as large as a previously known error tolerance δt, however. The actual entry time t2 is therefore in the interval [t7−δt; t7+δt].

The predetermined early time span T1 can in particular be measured in such a manner that the additional setpoint FBZ* has already definitely reached its maximum value FBZ0* at the actual entry time t2. In particular, this design embodiment makes it possible to ensure that the actual value FB of the bending force is also already adjusted as far as possible to the sum of the base setpoint FBB* and the additional setpoint FBZ*. Alternatively, the predetermined early time span t1 can however also be measured in such a manner that the additional setpoint FBZ* has certainly not yet reached its maximum value FBZ0* at the actual entry time t2. This design embodiment makes it possible in particular to guarantee that the resultant manipulated variable SR has a positive value at the actual entry time t2. The predetermined time span T1 is typically in the range between 0.5 s and 2.0 s, in particular between 0.8 s and 1.5 s, for example approximately 1.0 s.

A special way of determining the early time span T1 can also be combined with a special way of determining the additional setpoint FBZ* (or its maximum value FBZ0*). In particular, the early time span T1 can be determined in such a manner that at the actual entry time t2 "the bending force FB has already been adjusted as far as possible to the sum of the base setpoint FBB* and the additional setpoint FBZ*". At the same time, the additional setpoint FBZ* (or its maximum value FBZ0*) can however be determined in such a manner that the actual value FB of the bending force cannot at all reach the sum of the base setpoint FBB* and the additional setpoint FBZ* (for this reason the above wording has been put in quotation marks). The result of this procedure is that the resultant manipulated variable SR inevitably goes to a positive value—often even to the maximum value MAX—and remains there because the actually desired result (FB=FBB*+FBZ*) cannot be achieved.

A further possible design embodiment relates to the definition of the end time t6, while complying with the condition that the end time t6 is not after the stabilization time t3. Because, as already mentioned, the actual entry time t2 can be recorded without further ado or can be determined on the basis of recorded measured variables. Accordingly, it is possible without any problems to determine the end time t6 in such a manner that it is after the actual entry time t2 by a predetermined late period of time T2.

The predetermined late period of time T2 is preferably dimensioned in such a manner that the additional setpoint FBZ* maintains its maximum value FBZ0* up to a time whose distance from the actual entry time t2 has a predetermined value. In particular, this value can be in the range between 0.1 s and 1.0 s. For example, it can be between 0.2 s and 0.6 s. A value between 0.3 s and 0.4 s is particularly preferred. After this latter time, the additional setpoint FBZ* is then lowered—possibly abruptly, preferably gradually—from its maximum value FBZ0* to 0. Reaching the value 0 corresponds to the end time t6. Since the time period during which the additional setpoint FBZ* is lowered is also furthermore known, the end time t6 can be determined without further ado based on the actual entry time t2.

Alternatively, it is possible to determine the predetermined late period of time T2 based on the expected entry time t7. In this case, the determinations are not based on the actual entry time t2, but based on the expected entry time t7.

A further possible design embodiment relates to the manner in which the additional setpoint FBZ* (or its maximum value FBZ0*) is determined—for example by the control device 13. In particular, properties of the rolling stock 8 can be utilized. The properties are, on the one hand, actual variables or expected variables of the rolling stock 8, which the rolling stock 8 has or presumably has before rolling in the roll stand 1. Examples of such variables are the width, the thickness, the temperature and the chemical composition and possibly also the pre-treatment of the rolling stock 8. On the other hand, the properties are set targets that the rolling stock 8 should have after rolling in the roll stand 1. Examples of such variables are the width and the thickness of the rolling stock 8. Furthermore, mechanical properties of the roll stand 1 are known, for example the modulus of elasticity of the stand, the diameters of the working rollers 2, the diameters of the support rollers 3 and others. Finally, for example by the control device 13, expected values for operating variables of the roll stand 1 for rolling the rolling stock 8 are determined as part of the pass schedule calculation, in particular an expected value FE for the rolling force F. The additional setpoint FBZ* or its maximum value FBZ0* is preferably determined as a function of the properties of the rolling stock 8 and/or the expected value FE of the rolling force F. If necessary, the mechanical properties of the roll stand 1 can additionally also be concomitantly taken into account. The specific determination can be made using a formula or a table, for example. The formula or the table can be stored in the control device 13, for example.

A further possible design embodiment likewise relates to the manner in which the additional setpoint FBZ* or its maximum value FBZ0* is determined. In particular, the additional setpoint FBZ* can be determined in such a manner that the resultant manipulated variable SR assumes its maximum possible value immediately before the actual entry time t2. This determination of the additional setpoint FBZ* leads to the hydraulic valves 15, 16 being fully open at the actual entry time t2 and the entire working pressure pP of the hydraulic system (including accumulators) thereby stabilizing the entry. This procedure can be useful in particular in a heavy-plate train and in the front roll stands of a multi-stand finishing train (in the case of a metal strip). In principle, however, this procedure can also be used for rear roll stands of a multi-stand finishing train.

A final possible design embodiment also relates to the manner in which the additional setpoint FBZ* or its maximum value FBZ0* is determined. In particular, the additional setpoint FBZ* can be determined in such a manner that a drop in the actual value FB of the bending force at the actual entry time t2, which would occur if the additional setpoint FBZ* were not supplied to the bending feedback controller 14, is compensated for by at least 50%.

In many cases it will be sufficient if the hydraulic valves 15, 16 are not fully open, but only slightly. For such cases in particular, design embodiments are useful in which the minimum manipulated variable SM is specified and the minimum manipulated variable SM has a relatively low value, for example a value between 8% and 20% of the maximum possible modulation of the hydraulic valves 15, 16. However, a specification of a larger minimum manipulated variable SM for other cases should not be ruled out.

The present invention has many advantages. In particular, the entry is clearly stabilized. Furthermore, there is a reduction in the period of time that elapses from the entry time t2 until the actual value FB of the bending force again reaches the base setpoint FBB*. Finally, the threading process and the rolling process are stabilized as such.

Although the invention has been illustrated and described in more detail by the preferred exemplary embodiment, the invention is not limited by the examples disclosed, and other variants can be derived therefrom by a person skilled in the art without departing from the scope of protection of the invention.

LIST OF REFERENCE SIGNS

1 Roll stand
2 Working rollers
3 Support rollers
4, 6 Bearing journal
5 Working roller chocks
7 Support roller chocks
8 Rolling stock
9 Head of the rolling stock
10 Bending system
11, 12 Hydraulic cylinder units
13 Control device
14 Bending feedback controller
15, 16 Hydraulic valves
17 Evaluation unit
18 Foot of the rolling stock
19 Selection member
F Rolling force
FE Expected value
FB* Resultant setpoint
FBB* Base setpoint
FBZ* Additional setpoint
FBZ0* Maximum value
FB Actual value of the bending force
MAX Maximum possible value
pP, pT Working pressures
SB Basic manipulated variable
SM Minimum manipulated variable
SR Resultant manipulated variable
SZ Additional manipulated variable
t1 to t7 Times
T1, T2 Time spans
x Transport direction
δFB* Correction value
δt Error tolerance

The invention claimed is:

1. An operating method for a roll stand for rolling a flat rolling stock made of metal, the rolling stock having a head, wherein the roll stand has at least working rollers and support rollers, wherein the working rollers are mounted in working roller chocks and a bending system that presses the working roller chocks apart acts on the working roller chocks, wherein the head of the rolling stock reaches the roll stand at an actual entry time (t2), the operating method comprising:

supplying a base setpoint (FBB*) to a bending feedback controller to determine resultant setpoint (FB*) taking into account the base setpoint (FBB*), supplying the bending feedback controller with an actual value (FB) of the bending force, determining with the bending feedback controller a basic manipulated variable (SB) for the bending system, so that when the bending system is controlled with the basic manipulated variable (SB), the bending feedback controller the basic manipulated variable (SB) by means of the resultant setpoint (FB*) and the actual value (FB), the actual value (FB) being approximated to the resultant setpoint (FB*), and the bending feedback controller determining the resultant setpoint (FB*) as from a stabilization time (t3), the stabilization time (t3) being after the actual entry time (t2), taking into account an actual rolling force (F) occurring during the rolling of the flat rolling stock, during an entry period which begins before the actual entry time (t2) and ends after the actual entry time (t2), supplying the bending feedback controller with an additional setpoint (FBZ*) in addition to the base setpoint (FBB*), so that the bending feedback controller during the entry period determines the resultant setpoint (FB*) taking into account the base setpoint (FBB*) and the additional setpoint (FBZ*), and as a result the actual value (FB) of the bending force is greater than the base setpoint (FBB*) immediately before the actual entry time (t2), and/or determining, by applying an additional manipulated variable (SZ) to the basic manipulated variable (SB), a resultant manipulated variable (SR) and supplying the resultant manipulated variable (SR) to the bending system, and the bending system being thereby controlled in such a manner that the resultant manipulated variable (SR) is greater than the basic manipulated variable (SB), and/or supplying a selection member with the basic manipulated variable (SB) and a minimum manipulated variable (SM), and the selection member supplying the maximum of basic manipulated variable (SB) and minimum manipulated variable (SM) to the bending system.

2. The operating method as claimed in claim 1, wherein the additional setpoint (FBZ*), or the additional manipulated variable (SZ), or the minimum manipulated variable (SM) is raised monotonically from zero to a maximum value (FBZO*) from a beginning (t5) of the entry period with a finite gradient and/or is reduced monotonically from the maximum value (FBZO*) to zero at an end (t6) of the entry period with a finite gradient.

3. The operating method as claimed in claim 2, wherein an expected entry time (t7) is determined by means of path tracking for the rolling stock, and the beginning (t5) of the entry period is before the expected entry time (t7) by a predetermined early time span (T1).

4. The operating method as claimed in claim 2, wherein the end (t6) of the entry period is after the actual entry time (t2) by a predetermined late time span (T2).

5. The operating method as claimed in claim 1, wherein before the rolling stock is rolled in the roll stand, a maximum value of the additional setpoint (FBZ*) and/or the additional manipulated variable (SZ) and/or the minimum manipulated variable (SM) are determined as a function of properties of the rolling stock and/or as a function of an expected rolling force (FE).

6. The operating method as claimed in claim 1, wherein the maximum value of the additional setpoint (FBZ*) and/or the additional manipulated variable (SZ) and/or the minimum manipulated variable (SM) is determined in such a manner that the resultant manipulated variable (SR) assumes a maximum value (MAX) at the actual entry time (t2).

7. The operating method as claimed in claim 1, wherein the additional setpoint (FBZ*) and/or the additional manipulated variable (SZ) and/or the minimum manipulated variable (SM) are determined in such a manner that a drop in the actual value (FB) of the bending force at the actual entry time (t2) is compensated for by at least 50%.

8. A rolling unit for rolling a flat rolling stock made of metal, the rolling stock having a head, the rolling unit comprising:

a roll stand and a bending feedback controller, working rollers mounted at least in working roller chocks, and support rollers, a bending system that presses the working roller chocks apart, and a selection member, wherein the bending feedback controller actuates the bending system, wherein the head of the rolling stock reaches the roll stand at an actual entry time (t2), wherein a base setpoint (FBB*) is supplied to a bending feedback controller and the bending feedback controller determines a resultant setpoint (FB*) taking into account the base setpoint (FBB*), wherein the bending feedback controller is supplied with an actual value (FB) of the bending force, wherein the bending feedback controller by means of the resultant setpoint (FB*) and the actual value (FB) determines a basic manipulated variable (SB) for the bending system, so that when the bending system is controlled with the basic manipulated variable (SB), the actual value (FB) is approximated to the resultant setpoint (FB*), wherein the bending feedback controller determines the resultant setpoint (FB*) as from a stabilization time (t3) after the entry time (t2), taking into account an actual rolling force (F) occurring during the rolling of the flat rolling stock, wherein during an entry period which begins before the actual entry time (t2) and ends after the actual entry time (t2), the bending feedback controller is supplied with an additional setpoint (FBZ*) in addition to the base setpoint (FBB*), so that the bending feedback controller during the entry period determines the resultant setpoint (FB*) taking into account the base setpoint (FBB*) and the additional setpoint (FBZ*), and as a result the actual value (FB) of the bending force is greater than the base setpoint (FBB*) immediately before the actual entry time (t2), and/or by applying an additional manipulated variable (SZ) to the basic manipulated variable (SB), a resultant manipulated variable (SR) is determined and supplied to the bending system, and the bending system is thereby controlled in such a manner that the resultant manipulated variable (SR) is greater than the basic manipulated variable (SB), and/or the selection member is supplied with the basic manipulated variable (SB) and a minimum manipulated variable (SM), and the selection member supplies the maximum of basic manipulated variable (SB) and minimum manipulated variable (SM) to the bending system.

* * * * *